US006240270B1

(12) United States Patent
Mitsuya et al.

(10) Patent No.: US 6,240,270 B1
(45) Date of Patent: May 29, 2001

(54) COLOR IMAGE FORMING METHOD AND DEVICE USING POTENTIAL DIVISION DEVELOPMENT

(75) Inventors: Teruaki Mitsuya; Hiroyuki Mabuchi; Masayoshi Ishii; Koji Kato; Hisayoshi Kato, all of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/527,676

(22) Filed: Mar. 17, 2000

(30) Foreign Application Priority Data

Mar. 19, 1999 (JP) ..... 11-075836

(51) Int. Cl.[7] ..... G03G 15/08
(52) U.S. Cl. ..... 399/223; 399/252
(58) Field of Search ..... 399/252, 223, 399/228, 231, 232

(56) References Cited

U.S. PATENT DOCUMENTS 4,063,533 12/1977 White .
6,061,534 * 5/2000 Okada et al. ..... 399/51

FOREIGN PATENT DOCUMENTS 54-10869 5/1979 (JP) ..... G03G/15/09
55-113073 * 9/1980 (JP) .
11-184205 * 7/1999 (JP) .

* cited by examiner

*Primary Examiner*—Quana M. Grainger
(74) *Attorney, Agent, or Firm*—Sughrue, Mion, Zinn, Macpeak & Seas, PLLC

(57) ABSTRACT

A first developing unit comprising a plurality of developing rolls including a developing roll whose rotation direction is matched with the move direction of a photosensitive body and a developing roll whose rotation direction is made opposite to the move direction of the photosensitive body.

9 Claims, 4 Drawing Sheets

COLOR IMAGE FORMING METHOD AND DEVICE USING POTENTIAL DIVISION DEVELOPMENT

BACKGROUND OF THE INVENTION

1. Field of the Invention

This invention relates to an electrophotographic apparatus for rendering an image visible with color particles of toner, etc., such as a printer, a facsimile, or a copier, and in particular to a developing method in a developing process of forming a toner image on the surface of a record material and an electrophotographic apparatus using the developing method.

2. Description of the Related Art

A developing method and a developing unit in a related art will be discussed. A recording apparatus using an electrophotographic technology involves a developing process of rendering an image visible on the surface of a record material with color particles and a fixing process of fixing the visualized color particle image onto the record material. Powder called toner dedicated to electrophotography is used as the color particles.

The full surface of a photosensitive body is once charged and subsequently is irradiated with light, whereby partial discharge is executed. Here, potential contrast of charge and discharge areas is formed on the surface of the photosensitive body and is called an electrostatic latent image.

In the developing process, first a developer is used to charge toner particles of color particles. The developer is mixed powder of toner and carrier beads of magnetic particles. It is sealed in the developing unit and is agitated therein. At the time, the toner is charged by friction with the carrier beads. The developer is transported by a magnet roller called a developing roller to a developing position opposed to the electrostatic latent image on the surface of the photosensitive body. At this time, a "magnetic brush" where the developer is arranged like a brush along a magnetic line of force is formed at the position opposed to the photosensitive body. Thus, the developing method using the method of conveying the developer to the electrostatic latent image on the photosensitive body by means of the magnet roller is called magnetic brush development.

On the other hand, a method called bias development is frequently used as a method of visualizing an electrostatic latent image. In the bias development, a bias voltage is applied to a developing roller and toner particles charged by the action of an electric field produced between the latent image potential formed on the surface of a photosensitive body and the developing roller are separated from the developer on the surface of the developing roller and are moved to the surface of the photosensitive body, making an image. The above-described charge potential or discharge potential may be used is the talent image potential (namely, potential of image formation portion of photosensitive body). Generally, a method of using the charge potential as the latent image potential is called a normal developing method and a method of using the discharge potential is called a reverse developing method. Of the charge potential and the discharge potential, the potential not used as the latent image potential is called background potential. The bias voltage of the developing roller is set to the middle between the charge potential and the discharge potential and the difference from the latent image potential is called the developing potential difference. Likewise, the difference from the background potential is called the background potential difference. Normally, the developing potential difference on which the developing performance itself depends is set larger than the background potential difference. If the developing potential difference is large, a formed electric field, called a developing electric field, becomes strong and thus the developing performance is enhanced, needless to say. Likewise, the developing electric field can also be strengthened by a method of narrowing the distance between the developing roller and a photosensitive body or a method of reducing the electric resistance of the developer; the developing performance can be enhanced.

The method of using magnetic brush development for transporting a developer and using bias development to visualize an electrostatic latent image is a widely generally used developing method. This developing method is called magnetic brush bias development throughout the specification. The relative move direction between a developing roller and a photosensitive body may be the same or may be opposite. One developing unit may use more than one developing roller. A developing unit may comprise a number of developing rollers rotating in the same direction or may comprise a number of developing rollers rotating in different directions. In this case, a developing unit is also known wherein two adjacent developing rollers are made different in rotation direction so that they are rotated toward a photosensitive body from the position opposed to the developing rollers for making a developer branch to the photosensitive body as if the developer were a fountain from the position opposed to the developing rollers. Such a developing unit is disclosed, for example, in JP-B-54-10869, etc. Such a developing unit is called a fountain-type developing unit throughout the specification.

As a modified example of the described bias developing method of electrophotography, for example, a developing method as seen from long ago in JP-A-48-37148, etc., is also proposed wherein potential of charge and discharge areas of a photosensitive body is divided into two parts to provide an intermediate potential area, a first developing unit for executing normal development is placed in the discharge area and develops first toner, and a second developing unit for executing reverse development is placed in the charge area and develops second toner, whereby two types of toners are developed in one charge step and light application step (exposure step). In this developing method, toner is not developed in an intermediate potential area (called intermediate potential) on a photosensitive body having a voltage value sandwiched between the bias voltage value of the first normal developing unit and that of the second reverse developing unit and a background portion is formed as an image, so that it is possible to form an image made of two types of toners consisting of the background part, the first image part, and the second image part. This developing method is called the potential division developing method throughout the specification. In the potential division development, normally two types of toners are used as separate colors for the purpose of providing a dichromatic image. If the reverse development is adopted as the first development and the normal development is adopted as the second development, the potential division development is also possible.

The magnetic brush bias development involves a problem of making the margins of an image hard to develop toward the rotation direction of a developing roll. This problem occurs because a magnetic brush scrubs the surface of a photosensitive body as a mechanical factor and the potential of the photosensitive body with which the magnetic brush comes in contact changes abruptly from the background potential of a non-image part to the developing potential of an image part and thus the electrical characteristic of the developer cannot follow the change. In the normal magnetic brush bias development, the developing performance is enhanced for preventing an evil effect caused by the problem from occurring. However, in the potential division development, a potential difference larger from the potential difference between the background potential and the developing potential in the normal magnetic brush bias development may occur. That is, if the background part of an image comes in contact with the first or second image part, the potential corresponding to the background potential is intermediate potential; this state is similar to the relationship between the background potential and the developing potential in the normal magnetic brush bias development. However, on the boundary where the first and second image parts come in contact with each other, when the first image part is developed, the potential of the second image part corresponds to the background potential; when the second image part is developed, the potential of the first image part corresponds to the background potential. At the time, the background potential difference becomes larger than the developing potential difference; at this time, a state different from the relationship between the background potential and the developing potential in the normal magnetic brush bias development occurs. Thus, to execute development after the magnetic brush passes through the boundary, an evil effect is larger than that in the normal magnetic brush bias development wherein the background potential difference is smaller than the developing potential difference, and a problem of an image loss with the boundary neighborhood of the image undeveloped and made void is involved. This problem can occur in either the first or second color in principle depending on the magnetic brush scrubbing direction; in fact, however, only the image loss of the first color is noticeable. The reason is that the toner image of the first color already developed exists before the magnetic brush of the second color passes through the boundary and that the toner of the first color causes the image part potential of the first color to approach the intermediate potential and thus the image part potential difference between the first and second colors lessens as compared with the case where toner does not exist.

The described potential division developing method in the related art is lacking in considering the image part potential difference between the first and second colors and the magnetic brush scrubbing direction and involves a problem of an image loss occurring on the boundary where the first and second color images are contiguous to each other.

SUMMARY OF THE PRESENT INVENTION

It is therefore an object of the invention to provide a method of developing a good image free of the above-mentioned image loss in potential division development.

It is another object of the invention to provide an electrophotographic apparatus for printing a good image free of the above-mentioned image loss using the developing method.

In the invention, to provide a good image free of the above-mentioned image loss, a developing unit for developing the first color is provided with a plurality of developing rolls wherein the rotation direction of at least one of the developing rolls is matched with the move direction of a photosensitive body and the rotation direction of at least one of other developing rolls is made opposite to the move direction of the photosensitive body.

DETAILED DESCRIPTION OF THE PRESENT INVENTION

First Embodiment

A first embodiment of the invention will be discussed with FIGS. 1 to 5.

Figure 1:
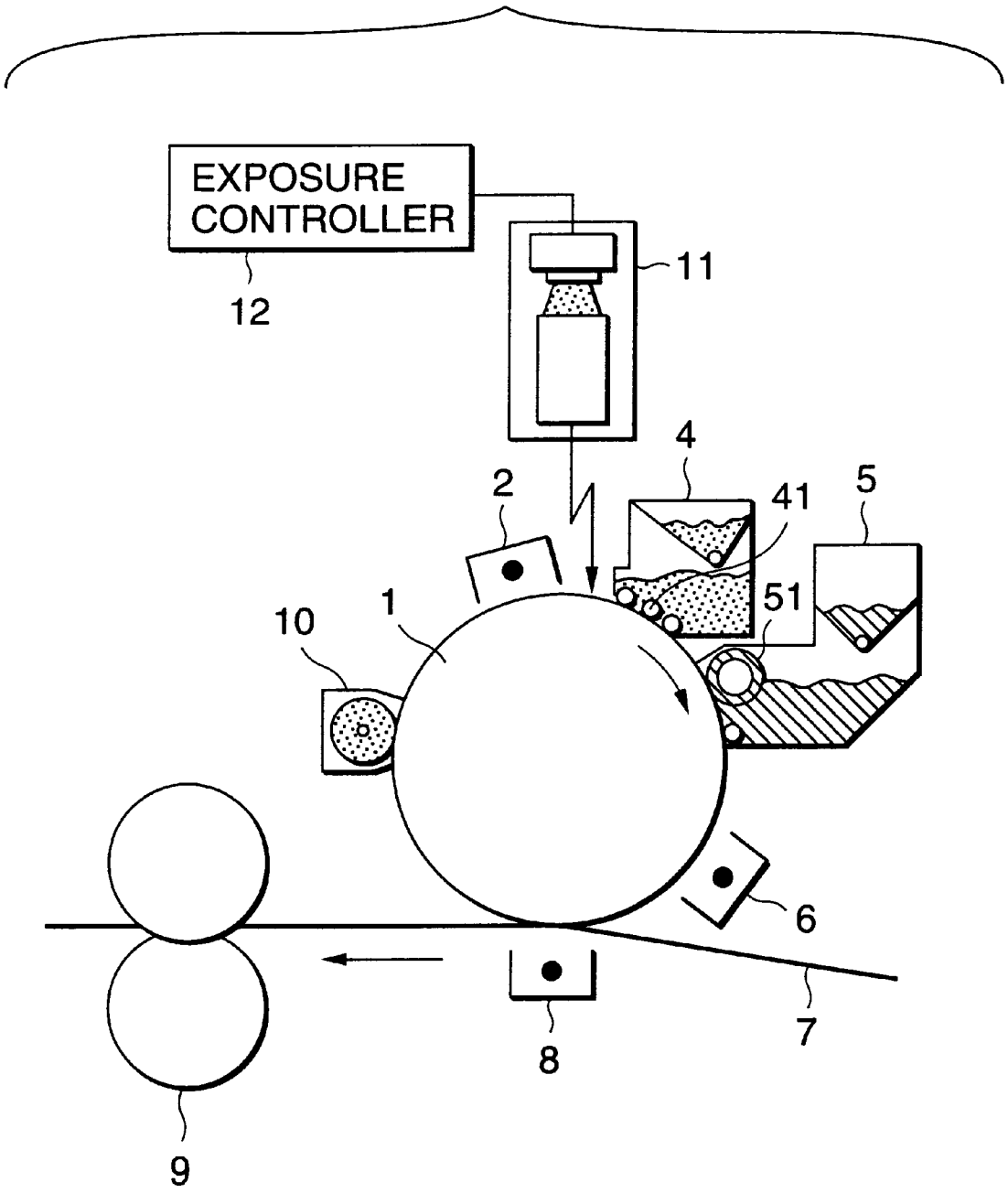
FIG. 1 is a sectional side view of a two-color laser-beam printer using a potential dividing developing method of the invention.

FIG. 1 is a sectional side view of a two-color laser-beam printer using a potential division developing method of the embodiment. Numeral 1 denotes a photosensitive drum, numeral 2 denotes a charger, numeral 4 denotes a first developing unit, numeral 41 denotes a developing roll of the first developing unit 4, numeral 5 denotes a second developing unit, numeral 51 denotes a developing roll of the second developing unit 5, numeral 6 denotes a pre-transfer charger, numeral denotes paper, numeral 8 denotes a transfer unit, numeral 9 denotes a fuser, numeral 10 denotes a cleaner, numeral 11 denotes an exposure unit, and numeral 12 denotes exposure controller On the surface of the photosensitive drum 1 charged uniformly by the charger 2, an electrostatic latent image is formed by the exposure unit 11 consisting of a semiconductor laser and an optical system whose light emission is controlled by the exposure controller 12 formed by a laser driver, etc. Thereafter, the two developing units 4 and 5 develop the electrostatic latent image in two color toners by the potential division developing method. Since the two color toners developed differ in charge polarity, the pre-transfer charger 6 is used to make the charge polarities uniform. The two color toners with the polarity made uniform by the pre-transfer charger 6 are transferred onto the paper 7 by the transfer unit 8. After this, the transferred two-color toner image is fused and fixed onto the paper 7 by the fuser 9. The toner not transferred and left on the surface of the photosensitive drum 1 is collected by the cleaner 10 and the process is complete.

Figure 2:
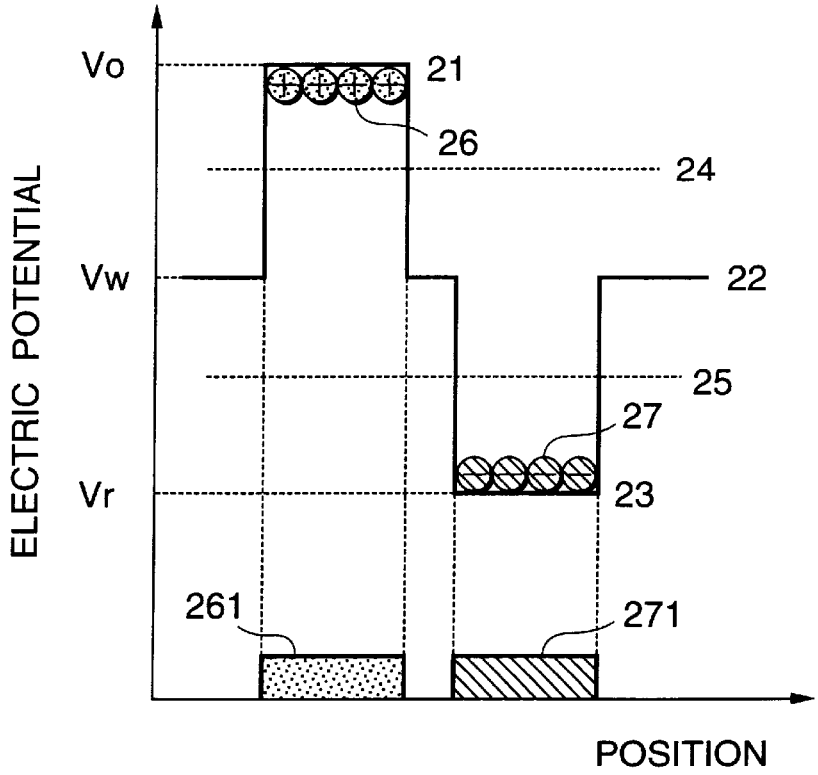
FIG. 2 is a drawing to show the relationship between a potential distribution and image placement of potential division development.

FIG. 2 is a drawing to show the relationship between a potential distribution and image placement of potential division development. Numeral 21 denotes a charge potential (Vo), numeral 22 denotes an intermediate potential (Vw) numeral 23 denotes a discharge potential (Vr), numeral 24 denotes a bias potential of the first developing unit, numeral 25 denotes a bias potential of the second developing unit, numeral 26 denotes positively charged toner, numeral 261 denotes a positively charged toner image, numeral 27 denotes negatively charged toner, and numeral 271 denotes a negatively charged toner image. The potential division development is a developing method wherein potential of the charge area 21 and the discharge area 23 of the photosensitive drum 1 is divided into two parts to provide the intermediate potential area 22, the first developing unit 4 for executing normal development is placed in the discharge area 23 and develops the first toner 26, and the second developing unit 5 for executing reverse development is placed in the charge area 21 and develops the second toner 27, whereby two types of toners are developed in one charge step and light application step (exposure step). In this developing method, toner is not developed in the intermediate potential area 22 (intermediate potential) on the photosensitive drum 1 having a voltage value sandwiched between the bias voltage value 24 of the first normal developing unit 4 and the bias voltage value 25 of the second reverse developing unit 5 and a background portion is formed as an image, so that it is possible to form an image made of two types of toners consisting of the background part, the first image part 261, and the second image part 271. In the potential division development, normally two types of toners are used as separate colors for the purpose of providing a dichroic image. If the reverse development is adopted as the first development and the normal development is adopted as the second development, the potential division development is also possible. Based on the described potential division development principle, in the two-color laser-beam printer of the embodiment, the exposure amount is controlled in two steps and the photosensitive drum surface potential is set to three levels of Vo, Vw, and Vr, whereby the unexposed part in which the positively charged toner 26 is normally developed (charge potential (Vo) 21), the strong-exposed part in which the negatively charged toner 27 is reversely developed (discharge potential (Vr) 33), and the weak-exposed part forming a white image area in which neither toner is developed (intermediate potential (Vw) 22) are formed. In the potential division development, if the background part of an image comes in contact with the first image part 261 or the second image part 262, the potential corresponding to the background potential is intermediate potential. However, if the first image part 261 and the second image part 262 come in contact with each other, when the first image part 261 is developed, the potential of the second image part 262 corresponds to the background potential; when the second image part 262 is developed, the potential of the first image part 261 corresponds to the background potential. At the time, potential allocation not occurring in the normal magnetic brush bias development occurs. That is, in the potential division development, the background potential difference becomes larger than the developing potential difference, and to execute development after a magnetic brush passes through the boundary, an evil effect is larger than that in the normal magnetic brush bias development wherein the background potential difference is smaller than the developing potential difference, and a problem of an image loss with the boundary neighborhood of the image undeveloped and made void is involved.

Figure 3:
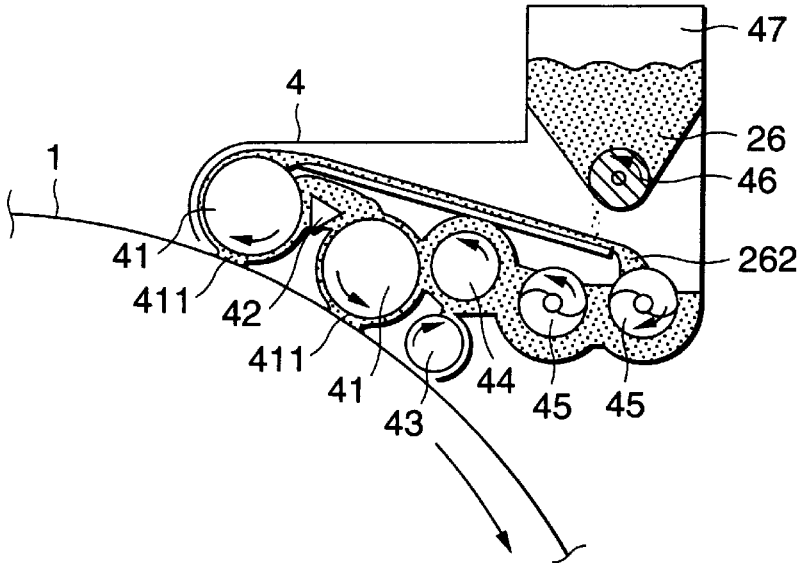
FIG. 3 is a sectional side view of a first developing unit of the invention.

The two-color laser-beam printer of the embodiment uses a fountain-type developing unit as the first developing unit 4. FIG. 3 is a sectional side view of the first developing unit 4 of he embodiment. Numeral 262 denotes a first color developer, numeral 411 denotes a magnetic brush, numeral 42 denotes a regulation member, numeral 43 denotes a carrier catch roll, numeral 44 denotes a developer transport roll, numeral 45 denotes an agitating screw, numeral 46 denotes a toner feed roll roll, and numeral 47 denotes a toner hopper. The first color developer 26 stored in the toner hopper 47 is fed into the developing unit 4 in response to rotation of the toner feed roll roll 46 controlled so as to always make a constant toner concentration of the first color developer 262. The first color toner 26 fed into the developing unit 4 is mixed with the first color developer 262 by the agitating screw 45, then is transported to the lower developing roll 41 by means of the developer transport roll 44. The first color developer 262 transported on the rear face of the lower developing roll 41 on the opposite side to the photosensitive drum 1 is made to branch in an equal amount to the upper and lower developing rolls 41 by the regulation member 42. The adjacent upper and lower developing rollers 41 are made different in rotation direction so that they are rotated toward the photosensitive drum 1 from the position opposed to the developing rollers 41 (position of the regulation member 42) for making the developer 262 branch to the photosensitive drum 1 as if the developer were a fountain from the position opposed to the developing rollers. The magnetic brushes 411 made of the developer 262 are formed at the developing positions corresponding to the positions where the surfaces of the upper and lower developing rolls 41 are closest to the photosensitive drum 1, and here development is executed. One charge latent image is developed each once by the magnetic brushes 411 of the upper and lower developing rolls 41. Hereinafter, the developing roll rotating at an opposite direction to the move direction of the photosensitive drum at the developing position opposed to the surface of the photosensitive drum, such as the upper developing roll, will be called a reverse roll and the developing roll rotating at the same direction as the move direction of the photosensitive drum at the developing position, such as the lower developing roll, will be called a forward roll.

Figure 4:
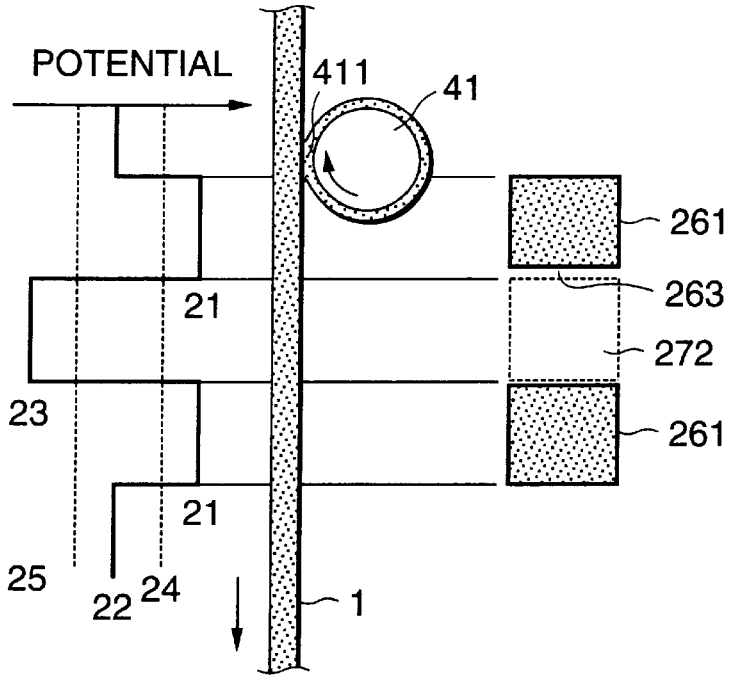
FIG. 4 is a drawing to show a state of a first color toner image provided when development of a first color of potential division development is executed by a reverse developing roll.

Next, the mechanism of the fountain-type developing unit for preventing an image loss will be discussed with FIGS. 4 and 5. FIG. 4 shows a state of the first color toner image 261 provided when development of the first color of potential division development is executed by the reverse developing roll 41. Numeral 263 denotes an image loss occurring area and numeral 272 denotes an image area in which the second color image is to be developed after the first color image is developed. FIG. 4 shows a state in which the first color development is complete before the second color development is executed; it shows the image area 272 because the second color toner image is not developed. For reference, a potential distribution formed on the surface of the photosensitive drum 1 is also shown corresponding to the positions on the photosensitive drum. In FIG. 4, there are two boundaries between first and second color image areas where the magnetic brush 411 passes through a large potential difference between the charge potential 21 and the discharge potential 23. The photosensitive drum 1 moves in the arrow direction in the figure. Therefore, the developing roll 41 moves while rotating on the surface of the photosensitive drum 1 relatively from the bottom to the top of the paper plane. At this time, the rotation speed is faster than the move speed. Therefore, when the developing roll 41 develops the latent image shown in FIG. 4, after the charge potential part 21 is developed, the discharge potential part 23 is scrubbed on the boundary between the first color image area (first color toner image 261 on the lower side with respect to the paper plane) and the second color image that the magnetic brush 411 first encounters. On this boundary, the potential of the discharge potential part 23 corresponds to the background potential and the background potential difference (difference between the potential of the discharge potential part 23 and the bias potential 24 of the first developing unit) becomes larger than the developing potential difference (difference between the bias potential 24 of the first developing unit and the potential of the charge potential part 21). In this case, however, if the characteristic of the magnetic brush 411 cannot instantaneously follow large potential change, it occurs in the discharge potential part 23 where development is not executed, and thus the effect does not appear on the image. Focusing attention on the boundary between the first color image area (first color toner image 261 on the upper side with respect to the paper plane) and the second color image that the magnetic brush 411 next encounters, like the boundary between the first color image area (first color toner image 261 on the lower side with respect to the paper plane) and the second color image that the magnetic brush 411 first encounters, the potential of the discharge potential part 23 corresponds to the background potential and the background potential difference (difference between the potential of the discharge potential part 23 and the bias potential 24 of the first developing unit) becomes larger than the developing potential difference (difference between the bias potential 24 of the first developing unit and the potential of the charge potential part 21). On the boundary, after the discharge potential part 23 is scrubbed, the charge potential part 21 is developed and voltage (difference between the charge potential 21 and the bias potential 24 of the first color developing roll) of an opposite polarity to that of large voltage (the bias potential 24 of the first color developing roll and the discharge potential 23) applied to the magnetic brush in the discharge potential part 23 is applied. When the magnetic brush 411 passing through the boundary develops the charge potential part 21, the amount of the first color toner moved from the magnetic brush 411 to the surface of the photosensitive drum 1, namely, the developed toner amount does not instantaneously become constant because of large voltage change, and becomes constant passing a transient state. This phenomenon can be interpreted as a so-called transient phenomenon if it is considered that the toner is charged particles and that the toner (charged particle) move is a charge move, namely, current itself. The following alternative interpretation is also possible: While the magnetic brush 411 is scrubbing the discharge potential 23, the toner receives a strong force in the direction of pressing the toner against the developing roll 41 (opposite direction to the developing direction). However, when the toner passes through the boundary and arrives at the charge potential part 21, a force in the developing direction, namely, a force of attracting the toner onto the photosensitive drum 1 acts on the toner. Since toner particles involve one mass, an acceleration period is required until the toner becomes a constant move amount in response to rapid change in the force acting direction, namely, constant move speed. In any way, after the magnetic brush 411 passes through the boundary, a period in which the development toner amount is less exists and an image loss occurs in the area 263 in the image 261 corresponding to the period.

Figure 5:
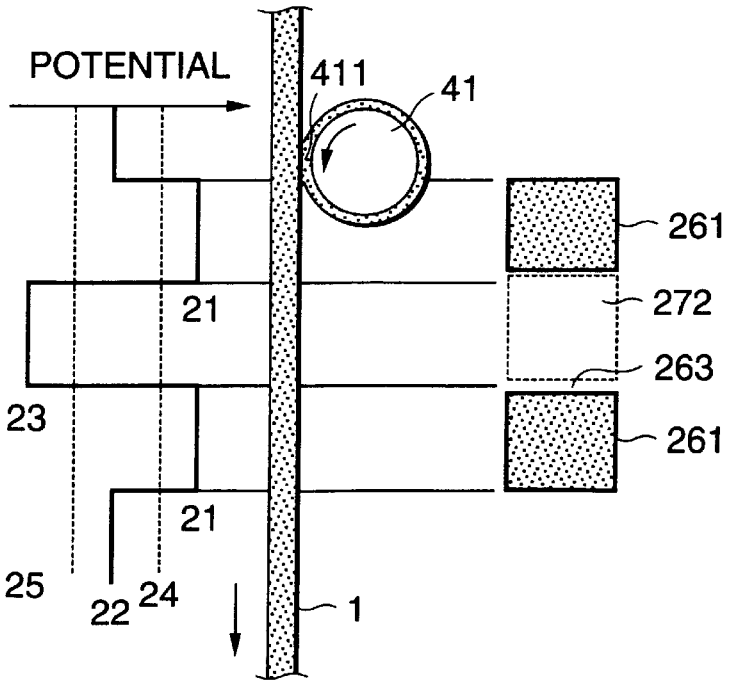
FIG. 5 is a drawing to show a state of a first color toner image provided when development of a first color of potential division development is executed by a forward developing roll.

FIG. 5 shows a state of the first color toner image 261 provided when development of the first color of potential division development is executed by the forward developing roll 41. Numeral 263 denotes an image loss occurring area and numeral 272 denotes an image area in which the second color image is to be developed after the first color image is developed. Like FIG. 5, FIG. 4 shows a state before the second color development is executed. In FIG. 5 like FIG. 4, there are also two boundaries between first and second color image areas where the magnetic brush 411 passes through a large potential difference between the charge potential 21 and the discharge potential 23. The photosensitive drum 1 moves in the arrow direction in the figure. Therefore, the developing roll 41 moves while rotating on the surface of the photosensitive drum 1 relatively from the bottom to the top of the paper plane; the rotation direction of the developing roll 41 matches the move direction of the photosensitive drum 1. Since the rotation speed is faster than the move speed of the developing roll 41, the magnetic brush 411 constantly gets ahead of the photosensitive drum 1 and scrubs the surface of the photosensitive drum 1 from the top to the bottom of the paper plane. Therefore, when the developing roll 41 develops the latent image shown in FIG. 5, after the discharge potential part 23 is scrubbed, the charge potential part 21 is developed on the boundary between the first color image area and the second color image that the magnetic brush 411 first encounters. On this boundary, voltage (difference between the charge potential 21 and the bias potential 24 of the first color developing roll) of an opposite polarity to that of large voltage (the bias potential 24 of the first color developing roll and the discharge potential 23) applied to the magnetic brush in the discharge potential part 23 is applied. When the magnetic brush 411 passing through the boundary develops the charge potential part 21, a period in which the development toner amount is less exists for a similar reason to that previously described with reference to FIG. 4 about the cause of an image loss because of large voltage change, and an image loss occurs in the area 263 in the image 261 corresponding to the period. On the boundary between the first and second color image areas that the magnetic brush 411 next encounters, after the charge potential part 21 is developed, the discharge potential part 23 is scrubbed. In this case, if the characteristic of the magnetic brush 411 cannot instantaneously follow large potential change, it occurs in the discharge potential part 23 where development is not executed, and thus the effect does not appear on the image. Thus, the reverse development and the forward development differ in occurrence position of image loss 263 as described with reference to FIGS. 4 and 5.

Since the fountain-type developing unit adopts the method of developing one latent image using both reverse development and forward development, a loss of the first color image in the proximity of the boundary between the first and second colors does not occur. That is, if the image loss 263 occurs in the upper developing roll 41 shown in FIG. 3, when the lower developing roll 41 executes development, normal development is executed at the position where the image loss 263 occurs in the upper developing roll 41. Thus, the image loss 263 does not occur when the latent image passes through the developing unit 4.

According to the described embodiment, if the fountain-type developing unit is used for the first development of the potential division developing method, the upper and lower developing rolls differ in image loss occurrence position, so that they are complementary to each other to overcome image loss, and an image loss of the first development image can also be prevented in the proximity of the nearby position of the first and second development images.

In the description of the embodiment, the fountain-type developing unit for first performing reverse development, next forward development is used as the first developing unit, but similar advantages to those provided in the embodiment do not depend on the order of forward development and reverse development. With the developing rolls of the developing unit using three or more developing rolls, similar advantages to those in the embodiment can also be provided if at least one developing roll differ in rotation direction from other developing rolls.

Second Embodiment

A second embedment of the invention will be discussed with reference to FIGS. 1, 4, and 5. In the description of the first embodiment, the rotation direction of the developing roll of the second developing unit is not mentioned, but the advantages of the invention can be provided regardless of whether the rotation direction of the developing roll 51 shown in FIG. 1 is forward or reverse, needless to say. However, if the rotation direction of the developing roll 51 of the second developing unit 5 is forward, a better effect of preventing the image loss 263 (FIGS. 4 and 5) of the first development image in the proximity of the nearby position of the first and second development images, an object of the invention, can be produced.

The reason is as follows: Of the first development images 261 provided by the first developing unit 4 containing the forward and reverse developing rolls 41 described in the first embodiment, the image at the position near to the second development image 271 in the rotation direction of the developing roll appears to be good, but is developed substantially only once because the forward and reverse developing rolls are complementary to each other to overcome image loss. Thus, when the second development is executed, the magnetic brush of the second developing roll 51 scrubs the image and the first image in the proximity of the nearby part is easily scraped. In the area where development is executed by more than one developing roll in the first development, toner having a loose adhesive force to the photosensitive drum, developed by the first developing roll is scraped by the next developing roll and is replaced with toner having a strong adhesive force, thus the image after passing through the first developing unit is comparatively hard to scrape. For the described reason, it is advisable to match the rotation direction of the second developing roll 51 with the move direction of the photosensitive drum 1 and reduce the relative peripheral speed of the developing roll 51 to the move speed of the photosensitive drum 1 in order to prevent the magnetic brush of the second developing roll 51 from scraping the image at the position near to the second development image 271 in the rotation direction of the developing roll, of the first development images 261.

Based on the described reason, the two-color laser-beam printer using the potential division developing method of the embodiment matches the rotation direction of the developing roll 51 of the second developing unit 5 at the developing position opposed to the surface of the photosensitive drum 1 with the move direction of the photosensitive drum 1, namely, adopts the forward developing roll as the developing roll 51.

According to the second embodiment described, the rotation direction of the second developing roll is forward, so that the magnetic brush of the second developing roll can be prevented from scraping the first development image in the proximity of the nearby position of the first and second development images, whereby an image loss can be better prevented and a good image can be provided.

Third Embodiment

Figure 6:
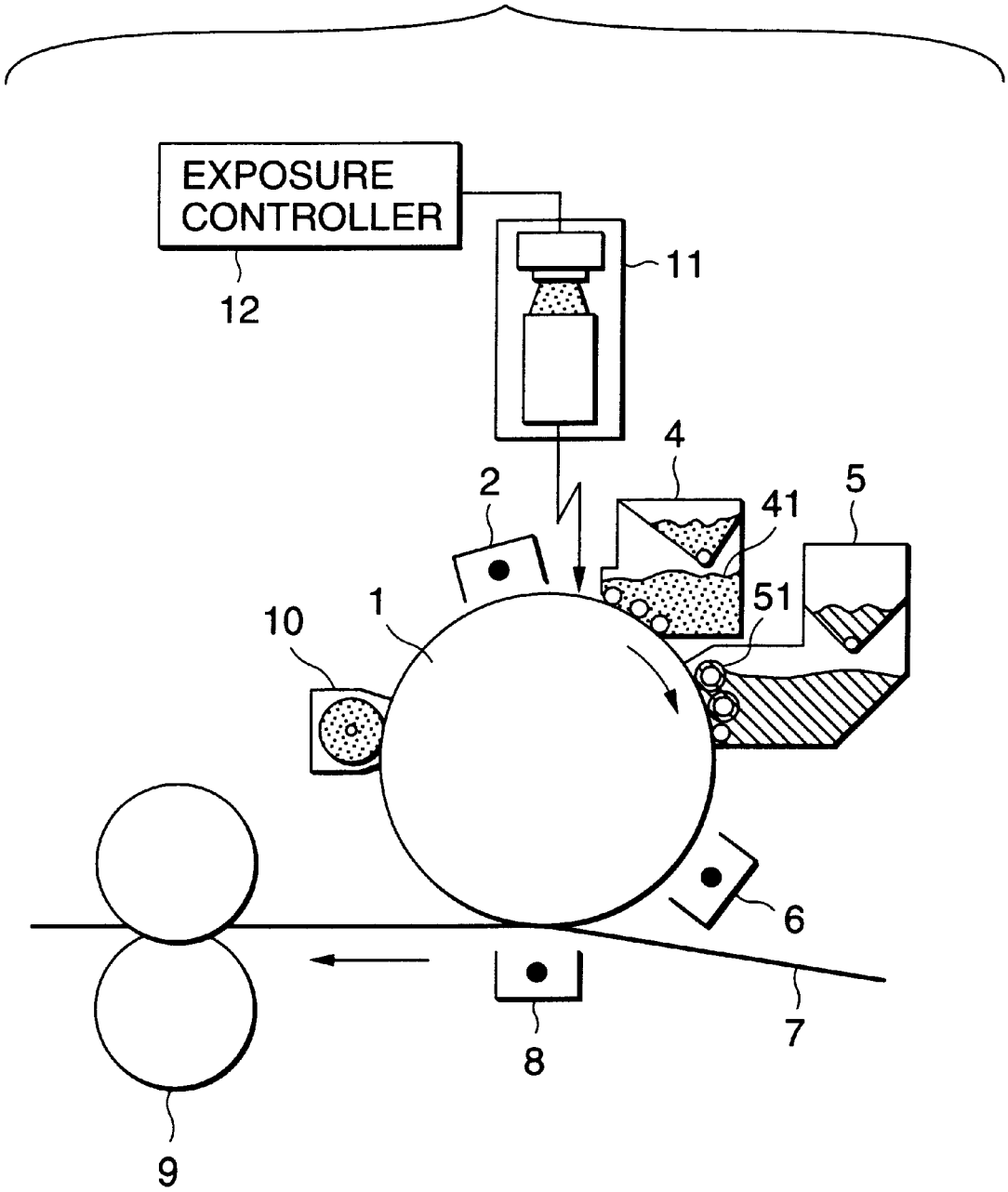
FIG. 6 is a sectional side view of a two-color laser-beam printer using a potential dividing developing method of a third embodiment of the invention.

A third embodiment of the invention will be discussed with reference to FIG. 6, which is a sectional side view of a two-color laser-beam printer using a potential dividing developing method of the third embodiment. The number of second developing rolls 51 in each of the first and second embodiments shown in FIG. 1 is one, but two forward developing rolls 51 are used in the third embodiment.

If a second developing unit 5 is provided with more than one forward developing roll 51, it is acknowledged that the scrape prevention effect similar to the above-described embodiment can be maintained. A new advantage that an ability margin of the second development is provided because of an increase in the toner supply amount at the developing time provided by more than one developing roll, making it possible to enhance the density of the second image is also added.

According to the described embodiment, two forward developing rolls are provided for the second development, so that the magnetic brush of the second developing roll can be prevented from scraping the first development image in the proximity of the nearby position of the first and second development images, needless to say; the advantage that the density of the second image can be enhanced is also provided. If three or more developing rolls of the second development are provided, the advantages of the embodiment are demonstrated and it is made possible to provide a higher density, needless to say.

According to the described invention, the developing unit for developing the first color is provided with a plurality of developing rolls wherein the rotation direction of at least one of the developing rolls is matched with the move direction of the photosensitive body and the rotation direction of at least one of other developing rolls is made opposite to the move direction of the photosensitive body, so that the developing roll whose rotation direction is matched with the move direction of the photosensitive body and the developing roll whose rotation direction is made opposite to the move direction of the photosensitive body are complementary to each other to overcome image loss using the characteristic of different image loss occurrence positions. Thus, an image loss of the first development image in the proximity of the boundary between the first and second development images can be prevented, a method of developing a good image free of any image loss can be provided, and an electrophotographic apparatus for printing a good image free of any image loss using the developing method can be provided.

What is claimed is:

1. An electrophotographic apparatus in which a potential division developing method is used having an image area where a background potential difference is set larger than a developing potential difference, the electrophotographic apparatus comprising:

a photosensitive body having a surface;

a charger for uniformly charging the photosensitive body;

an exposure unit forming at least a high potential area, an intermediate potential area and a low potential area on the surface of the photosensitive body;

a first developing unit including a plurality of first developing rollers for moving a plurality of first color particles to one of the high potential area and the low potential area on the photosensitive body; and a second developing unit including a second developing roller for moving a plurality of second color particles to the other one of the high potential area and the low potential area on the photosensitive body, wherein the rotation direction of at least one of the plurality of first developing rolls is matched with the moving direction of the surface of the photosensitive body; and the rotation direction of at least one of the plurality of first developing rolls is made opposite to the moving direction of the surface of the photosensitive body.

2. The electrophotographic apparatus as claimed in claim 1 wherein at least two adjacent ones of the plurality of first developing rolls of the first developing unit are made different in rotation direction.

3. The electrophotographic apparatus as claimed in claim 1 wherein the rotation direction of the second developing roll in the second developing unit is matched with the moving direction of the surface of the photosensitive body.

4. The electrophotographic apparatus as claimed in claim 3 wherein the second developing unit comprises a plurality of developing rolls.

5. A method of forming an image on a photosensitive drum in an electrophotographic apparatus comprising the steps of:

rotating the photosensitive drum in a direction;

charging a surface of the photosensitive drum uniformly;

irradiating a beam of laser on the surface of the photosensitive drum to form at least a high potential area, an intermediate potential area and a low potential area on the surface of the photosensitive body;

rotating at least one of a plurality of first developing rollers in the same direction as that of the photosensitive drum;

rotating at least one of the plurality of first developing rollers in the opposite direction to that of the photosensitive drum; and moving a plurality of first color particles onto one of the high potential area and the low potential area on the surface of the photosensitive drum by the plurality of first developing rollers.

6. The method as claimed in claim 5, wherein the adjacent ones in the plurality of first developing rollers rotate in opposite directions to each other.

7. The method as claimed in claim 5, further comprising the steps of:

rotating a second developing roller; and moving a plurality of second color particles onto the other one of the high potential area and the low potential area on the surface of the photo sensitive drum by the second developing roller.

8. The method as claimed in claim 7, wherein the second developing roller rotates in the same direction as that of the photosensitive drum.

9. The method as claimed in claim 8, wherein the second developing roller comprises a plurality of second developing rollers.

* * * * *